US006691636B2

(12) United States Patent
King

(10) Patent No.: US 6,691,636 B2
(45) Date of Patent: Feb. 17, 2004

(54) METHOD OF DEPLOYING CABLE

(75) Inventor: Robert King, Pompano Beach, FL (US)

(73) Assignee: American Systems Corporation, Chantilly, VA (US)

( * ) Notice: Subject to any disclaimer, the term of this patent is extended or adjusted under 35 U.S.C. 154(b) by 10 days.

(21) Appl. No.: 09/916,048

(22) Filed: Dec. 27, 2001

(65) Prior Publication Data

US 2003/0164134 A1 Sep. 4, 2003

Related U.S. Application Data

(63) Continuation of application No. 09/916,049, filed on Jul. 26, 2001.

(51) Int. Cl.[7] ..... B63G 8/14; F16L 1/00
(52) U.S. Cl. ..... 114/331; 405/158
(58) Field of Search ..... 114/312, 321, 114/322, 244, 254, 330, 331; 405/154.1, 158, 190, 191

(56) References Cited

U.S. PATENT DOCUMENTS 3,157,145 A * 11/1964 Farris et al. ..... 114/332
3,943,869 A * 3/1976 Frechette ..... 114/330
3,961,589 A * 6/1976 Lombardi ..... 114/254
4,185,580 A * 1/1980 Pujol et al. ..... 405/158
4,577,583 A * 3/1986 Green, II ..... 114/332
4,850,551 A * 7/1989 Krawetz et al. ..... 244/97
4,974,536 A * 12/1990 Archibald ..... 114/312
5,398,636 A * 3/1995 Hillenbrand ..... 114/312
5,722,793 A * 3/1998 Peterson ..... 405/158
6,269,763 B1 * 8/2001 Woodland ..... 114/250
6,350,085 B1 * 2/2002 Bath et al. ..... 405/154.1

OTHER PUBLICATIONS

"Theseus: A Cable–Laying AUV" Bruce Butler and Vince den Hertog, ISE Research, Ltd., pp 1–6, 1999.*
"Theseus, An Autonomous Underwater Cable Laying Vehicle" ISE Research, Ltd., pp. 1–3, 2001.*

* cited by examiner

*Primary Examiner*—S. Joseph Morano
*Assistant Examiner*—Andrew Wright
(74) *Attorney, Agent, or Firm*—Andrew B. Katz, Esq.

(57) ABSTRACT

A method of deploying cable in a body of water comprising an autonomous underwater vehicle (AUV) capable of converting vertical motion into horizontal travel, and placing cable in the body of water with the AUV. The cable, usually a cable sensor array, is released from a cable storage section of the AUV as the AUV glides horizontally. Vertical motion can be provided by buoyancy change, by dropping the AUV into the water, or by release of the AUV from a weighted bunker at the bottom.

20 Claims, 6 Drawing Sheets

METHOD OF DEPLOYING CABLE

CROSS REFERENCE TO RELATED APPLICATIONS

This application is a continuation in part of Ser. No. 09/916,049 filed Jul. 26, 2001.

BACKGROUND OF THE INVENTION

This invention relates to methods for deploying cable in a body of water. This invention is especially useful for deploying temporary fiber optic cables and cables with integral sensors, known as sensor arrays, in an ocean.

Sensor arrays are usually deployed from surface ships which release the cable from a cable storage device such as a spool and allow the sensor arrays to sink to a desired location. In a desire for covertness, it has been suggested to deploy large arrays and cables from submarines through a torpedo hatch, but this requires very complex and expensive installations that reduce the submarine war fighting capabilities and have been very difficult, if not impossible to implement successfully.

The use of surface ship systems to deploy sensor arrays is cumbersome, expensive, and manpower intensive. There are also difficulties encountered when trying to connect several legs of arrays in a star pattern to a central connection point, a necessary deployment style for several applications. Problems are also encountered when trying to deploy multiple arrays connected to a central umbilical cable. In both of these cases the surface ship needs to lay a track over each individual leg of the cables and arrays. In addition, they must be interconnected at a common connection point after the lay is completed, a very difficult task, especially in deep water. For some time there has been a desire to find a more efficient, effective, flexible and economical means for laying sensor arrays in a body of water.

It is therefore an object of the present invention to provide an improved method for deploying cables and arrays in a body of water effectively and efficiently.

SUMMARY OF THE INVENTION

This object, and others which will become apparent from the following disclosure, are achieved by the present invention which comprises in one aspect a method for deploying cable in a body of water comprising providing an autonomous underwater vehicle (AUV) capable of converting vertical motion into horizontal travel, having a housing for storing cable and adapted to release cable in the body of water, and placing the cable in the body of water with the AUV.

AUVs that use buoyancy as a means of propulsion are commonly known as sea gliders, and these two terms are used interchangeably. Sea gliders have wings which are used to develop lift with a component of force in the horizontal direction that drives the vehicle forward. Several relatively small sea gliders have been built and used for oceanographic research, but no one has heretofore suggested using sea gliders for deploying cable.

One embodiment of the method of the invention employs AUVs that are relatively inexpensive and expendable and thus can be used as anchors for the deployed cable. The method uses sea gliders that include a housing for storing and release of the cable and array with the housing and release system, preferably on the stem or aft portion of the AUV.

One embodiment of the method of this invention uses sea gliders that have constant negative net buoyancy, in which case the sinking of the AUV from the surface of the water is used to develop the glide having the horizontal vector. In another embodiment the buoyancy is positive, in which case the AUV can be released from the bottom of the body of water and the rising to the surface used to develop a glide having a horizontal vector. In this embodiment, a simple flooding mechanism can be used to allow the sea glider to sink when it nears the surface (i.e. becomes negatively buoyant) for a doubling of the horizontal range. For much longer deployments, limited only by the size and power source of the sea glider, one of several methods can be used to cycle the net buoyancy between a positive and negative value, thereby causing the AUV to fall or rise in the body of water, and to convert the vertical motion in each direction into horizontal travel. Depending on the particular mission requirements, either fixed or controllable pitch wings can be utilized.

The sea glider can be dropped from the surface to begin the cable deployment, or released from a submarine through the torpedo hatch or, if size limitations for the particular mission dictate using a unit too large for torpedo tube launch, the AUV can be externally mounted and deployed. The sea glider can also be released from a weighted bunker, which has been placed on, or dropped, to the bottom of the body of water. At the end of the cable deployment, the AUV can act as an anchor for the cable. Similarly the bunker, if so used, acts as an anchor for the cable and/or array. The sea glider or the weighted bunker, if so used, can also house power, electronics, and or communications equipment associated with the particular array or cable deployed. Surface and/or sub-surface buoys and location devices can be deployed from any point(s) desired.

In the embodiments using a weighted bunker, one or more sea gliders can be housed within the weighted, negatively buoyant bunker which is dropped to or placed on the bottom of the water. When released from the bunker, each AUV rises and glides, releasing cable from the cable housing during the glide. For multiple legs from a central point, the individual cables and associated electronics can be connected within the bunker prior to deployment.

In deployment applications having a primary umbilical cable with array legs or spurs connected to it, the umbilical cable can be laid using a conventional surface ship with the individual legs deployed by dropping sea gliders from the surface vessel with the cable end prespliced into the primary umbilical cable. This permits the surface ship to run on the primary track only, saving time, track coverage, and eliminating the problem of connecting multiple cables after the arrays are laid.

One embodiment encompasses the use of sea gliders that have been adapted for submarine launch from torpedo or vertical launch tubes. Multiple legs can be deployed serially at the end point of the previous leg. In such cases, the AUV contains a locating device to assist the submarine in finding the AUV at the end point. In those cases where individual legs are laid, sub-surface buoys can be deployed at both ends for later mating. Alternatively, one end of the cable can be kept aboard the submarine for attachment between legs that begin in a common area (such as for star pattern deployments or double length legs). Depending on the particular mission, the submarine can keep the free end of a sea glider deployed cable and array and process data in real time.

Another series of embodiments provide one or more AUVs encapsulated and dropped from aircraft. A relatively simple sea glider configuration can be placed in a modified sonobuoy and dropped from a P3 type aircraft. The sonobuoy would house a small, heavy (i.e. negatively buoyant) sea glider that is released on water impact. A dead weight package with electronics, battery, and cable termination would drop vertically to the sea floor while the sea glider with the free end of the array travels horizontally, deploying the array and cable in a predetermined direction to the sea floor. A surface buoy with RF antenna would be deployed from the dead-weight package, either on impact, at a predetermined time, by later command, or automatically when a target is detected, for example. A vertical array can also be deployed from the dead-weight package on the bottom. In such case, a small subsurface buoy would hold the vertical array with the RF antenna supported from the subsurface buoy to provide a relatively stable vertical array devoid of the negative affects associated with the motion of the seas, as opposed to a surface suspended system that can have substantial undesired mobility, especially in a near-shore environment.

Sea glider alternating vertical motion can be provided by a subsystem which changes the buoyancy of the AUV. For example, compressed gas in combination with a blow valve, ballast tanks, and a programmed processor can be used to produce alternating flood and blow cycles, which cause the sea glider to cycle through sinking and floating, each motion being converted by the AUV into horizontal gliding travel. The sea glider buoyancy can also be provided by a power source such as a chemical gas generator or a mechanical pump which derives energy from any source, for example a battery, fuel cell, or any other known power source for conventional AUV power.

If acoustic stealth is also required for a unit with multiple glide cycles, the method of blowing and flooding can incorporate quiet orifice and valve systems which are conventional in some submarine applications.

If control of the center of buoyancy of the sea glider is needed because the array package is large compared to the size of the vehicle (i.e weight is lost and the center of gravity changes while cable is being deployed), control may be maintained by using strategically placed multiple tanks that can be flooded or blown individually as needed.

The track location of an array deployment can be measured, and if desired, controlled using existing AUV underwater navigation and control equipment. Alternatively, the sea glider can deploy a simple antenna to the surface at any point along the deployment track to get a Global Positioning System (GPS) fix and either use the information for repositioning or to log location.

These methods can be utilized in any body of water such as an ocean, sea, bay, river, harbor, or lake. There is no limit to the maximum depth this method can be used or the lengths of those deployments dependant on the AUV size, materials used, and power source available.

BRIEF DESCRIPTION OF THE DRAWINGS

The figures depict an embodiment of the present invention, for purposes of illustration only, based on use of a multi-cycle sea glider powered by stored onboard compressed gas. One skilled in the art can readily recognize from the following discussion that alternative embodiments of the structures and methods illustrated herein may be employed without departing from the principles of the invention described herein. The depiction may be better understood by referring to the drawings in which.

DETAILED DESCRIPTION

Figure 1:
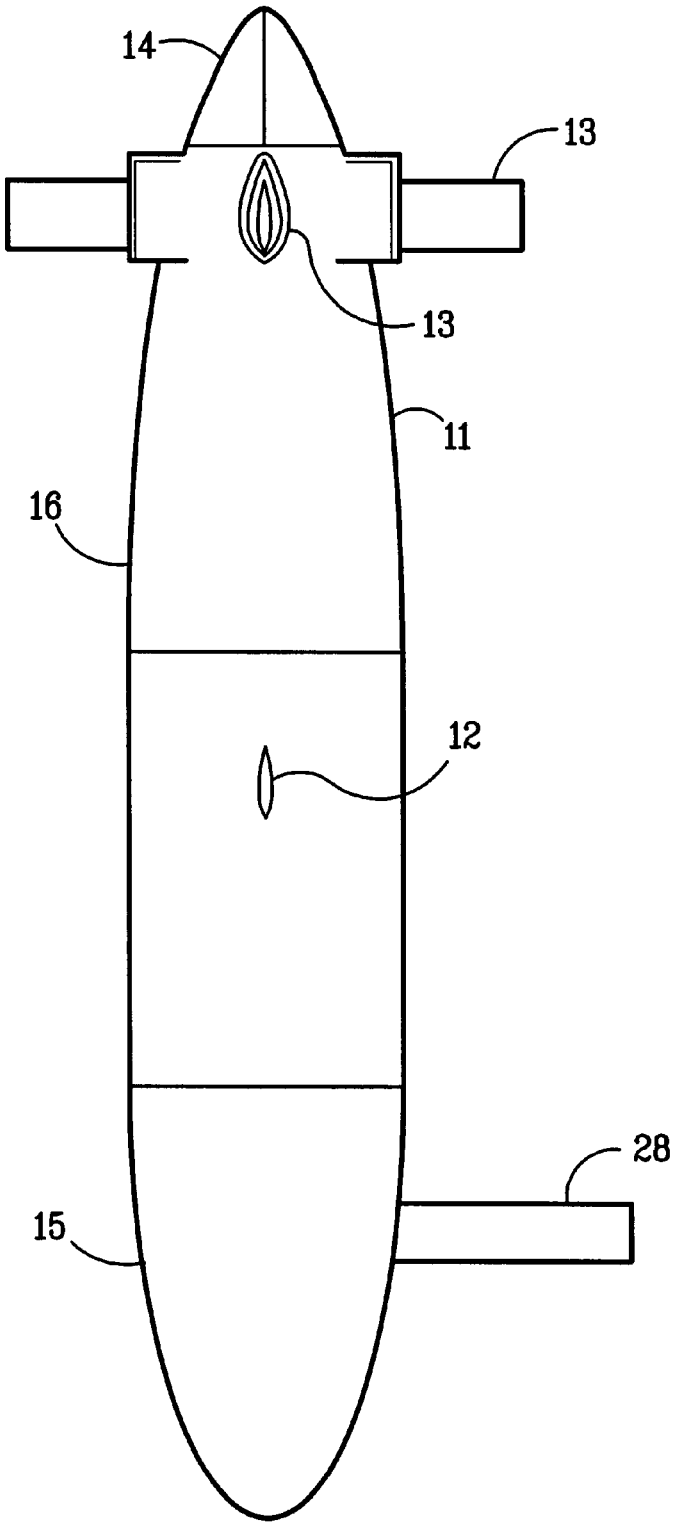
FIG. 1 is a portside view of a sea glider useful in the method.

FIG. 1 illustrates an AUV having a streamlined body 11, wings 12, control surfaces 13, forward ballast tank 15, aft ballast tank 16, means for determining location and tracking direction 28, and a split section cable deployment housing 14. Means for determining location and tracking direction 28, illustrated as a generic rectangular box, can be any form of antenna that can be deployed from the AUV and is capable of providing a Global Positioning System (GPS) fix. The GPS fix information can be used for repositioning or to log location of the AUV.

The tail section of the hull is split in four sections which are spring loaded shut. The split sections can open when the larger sensor components of an array are deployed, and then can then close to improve the hydrodynamics of the vehicle. A half-inch opening between the sections allows fiber optic cable and small sensors arrayed periodically along its length to be deployed without the sections opening. Four independent servomotors to provide dynamic stability activate the four control surfaces.

Figure 2:
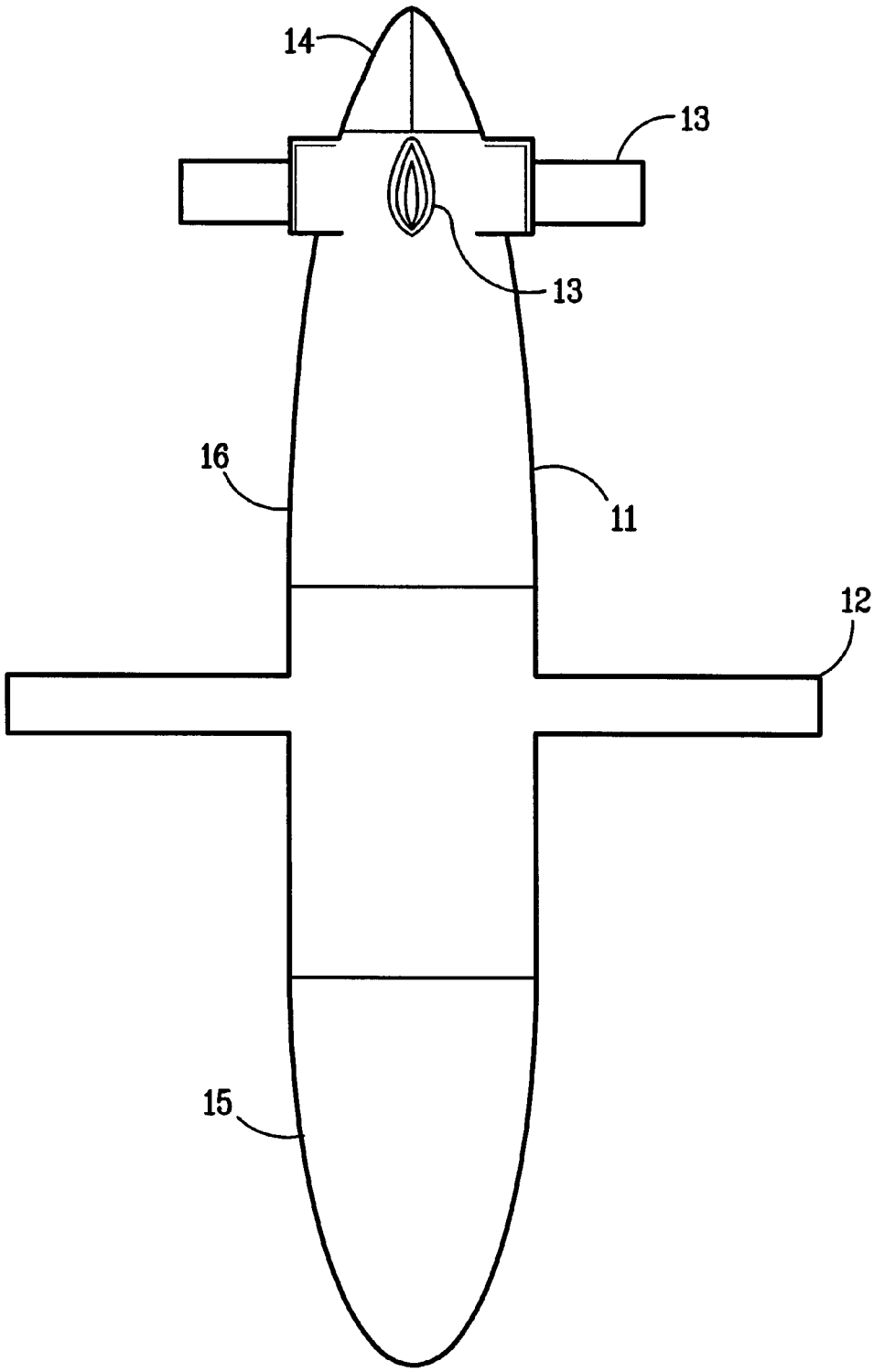
FIG. 2 is a topside view of the sea glider of FIG. 1.

FIG. 2 shows streamlined body 11 comprising forward ballast tank 15 and aft balance tank 16. The cable 23 (FIG. 4) and sensor array 29 (FIG. 5) are housed in split section cable deployment housing 14. Referring to FIG. 5, sensor array 29 comprises fiber optic cable 24 and sensors 25. Sensors 25 are illustrated as generic rectangular boxes because they can be any type of sensors that are conventionally used with sensor arrays.

Figure 3:
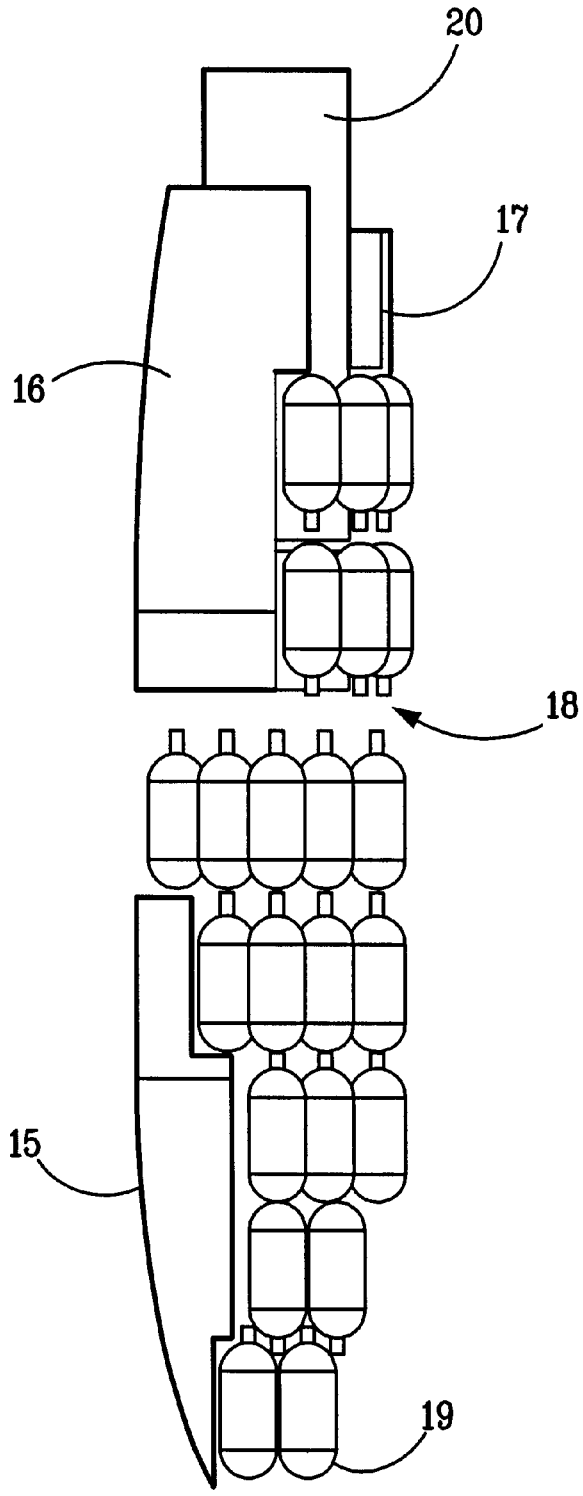
FIG. 3 is a cutaway elevation view of a sea glider which illustrates multiple air tanks as the power source to supply buoyancy

FIG. 3 shows a forward ballast tank 15, aft balance tank 16, battery can 17, computer can 18, and air tanks 19. Within split section cable deployment housing 14, cable sensor array 29 (FIG. 5), or cable 23 (FIG. 4) is housed in single section deployment housing 20. The air tanks 19 can be operated independently of each other to control the location of loss of air mass for each glide cycle.

Figure 6:
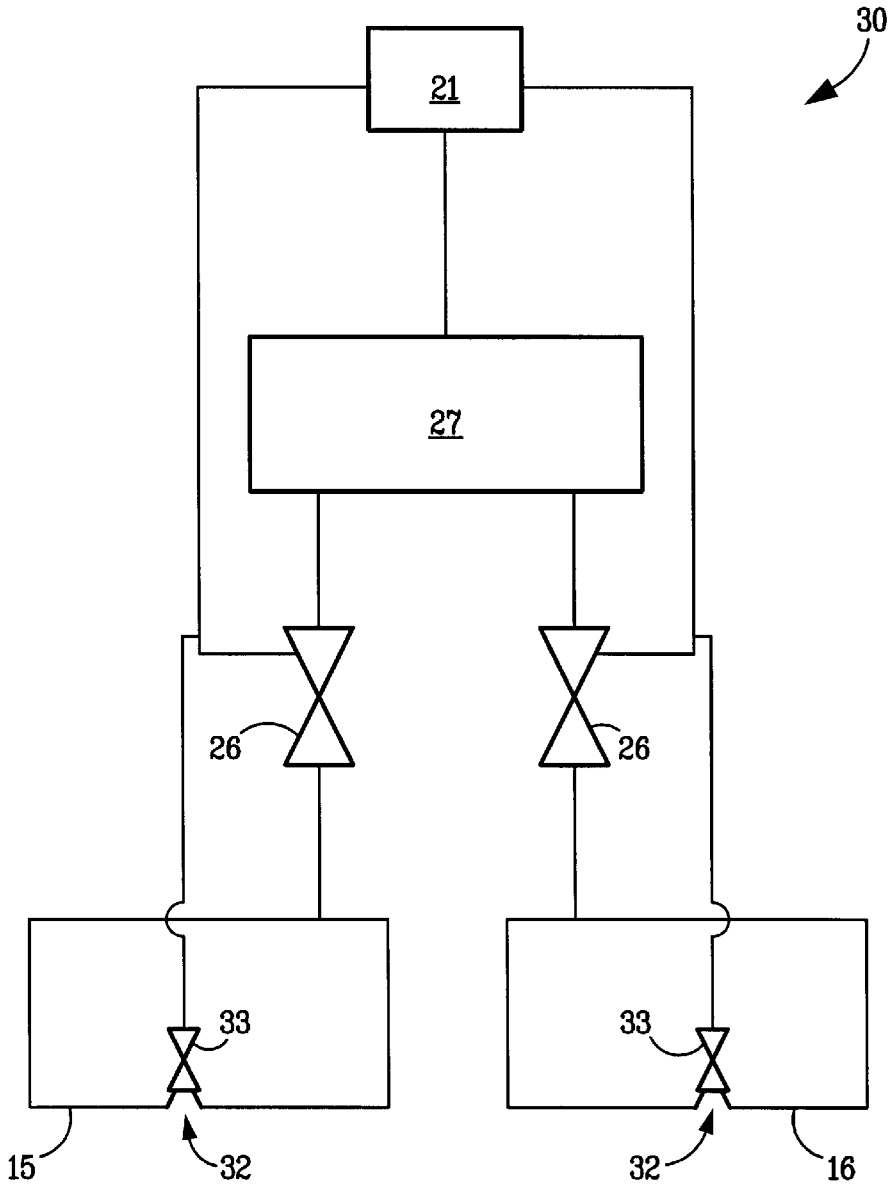
FIG. 6 is a schematic of a compressed gas system used to control the buoyancy of the AUV of FIG. 1 by producing flood and blow cycles.

Computer can 18 (FIG. 3) contains the necessary electronics and circuitry to control the features of the AUV of the present invention, such as controlling the attitude of wings 12 and control surfaces 13 (FIG. 1). Specifically, computer can 18 comprises a processor 21 (FIG. 6). Processor 21 can be any type of properly programmed processor. Processor 21 is powered by the batteries and can control positive and negative vehicle buoyancy as discussed above. The forward and aft ballast tanks, 15, 16, are alternately filled with water and evacuated to impart the needed level of net buoyancy. Processor 21 is generically illustrated in FIG. 6 as a rectangular box because using a processor/controller to control the internal functions of an AUV is conventional in AUV technology.

Figure 4:
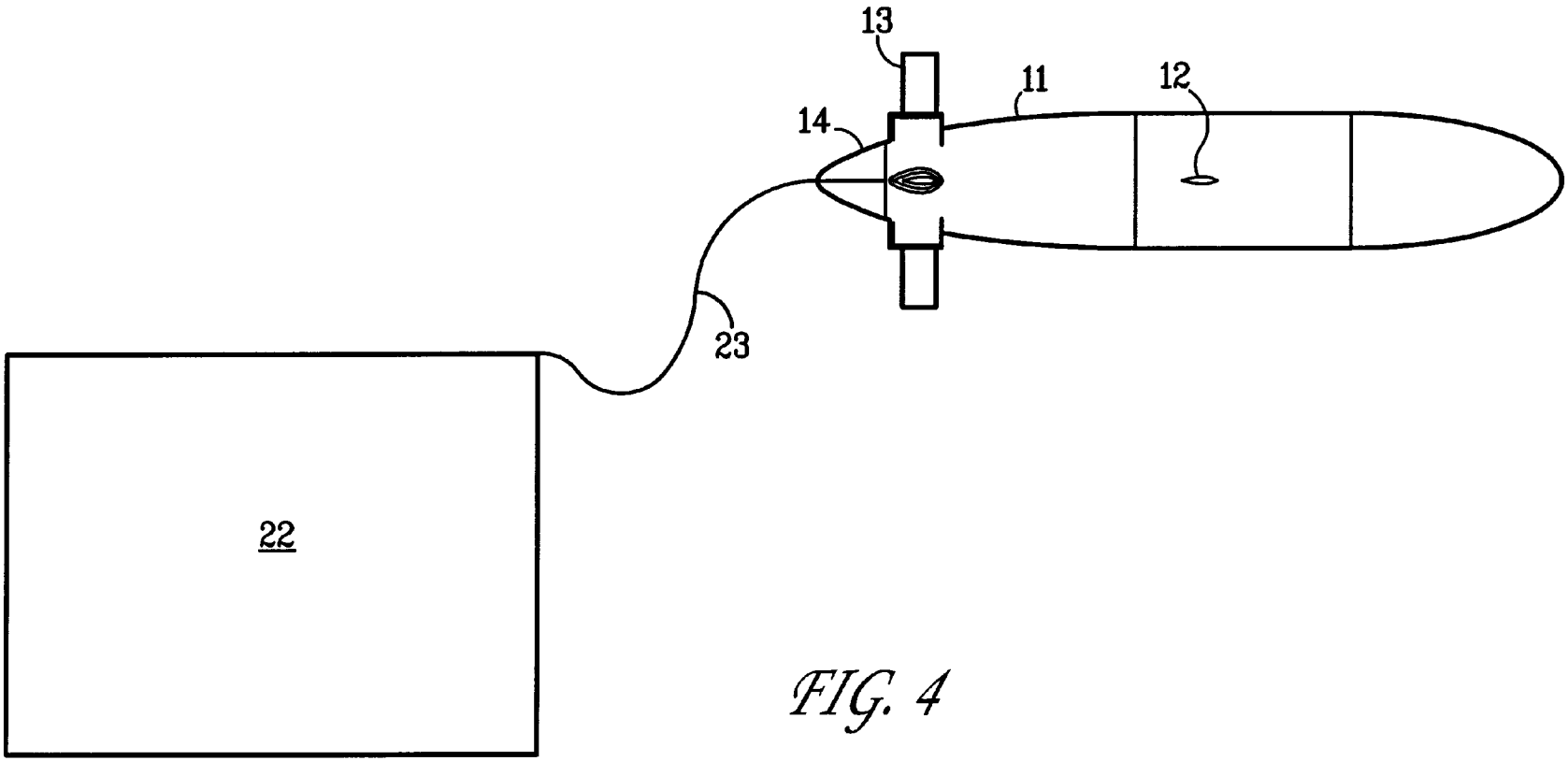
FIG. 4 is a side view of the sea glider of FIG. 1 deploying a cable that is connected to a deployment platform on one end and to the sea glider on a second end.
Figure 5:
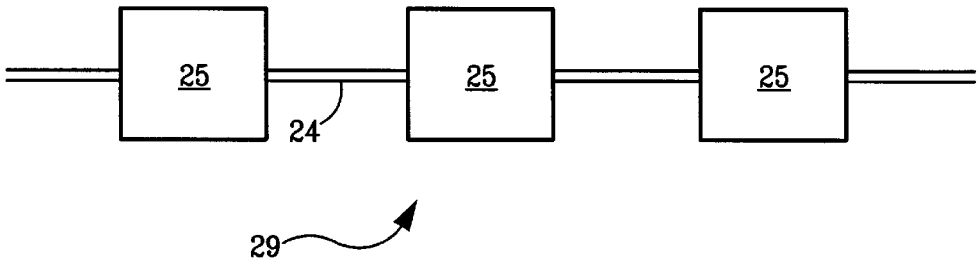
FIG. 5 is top view of a sensor array comprising sensors and a fiber optic cable.

Referring to FIG. 4, the sea glider of the present invention is illustrated deploying cable 23 that is connected to a deployment platform 22 on one end and to the sea glider on the second end. Supply of cable 23 is housed within split section cable deployment housing 14. Because cable 23 is anchored on one end to deployment platform 22, as the sea glider travels horizontally in the desired direction, cable 23 exits the split tail section 14 of the hull. Deployment platform 22 is generically illustrated. Those skilled in the art will appreciate that a deployment platform can be any structure from which an AUV can be deployed. Alternatively, deployment platform 22 can be a weighted bunker.

FIG. 6 is a simplified diagrammatic representation of a compressed gas system 30 that can be used in connection with the AUV of the present invention to control the buoyancy of the AUV by performing flood and blow cycles. Compressed gas system 30 comprises processor 21 which, as mentioned above, can be any properly programmed computer processor. Processor 21 is operably connected to compressed gas source 27 and blow valves 26, 33. In turn, compressed gas source 27, blow valves 26, 33 and forward and aft ballast tanks 15, 16, are all operably combined. In operating this system to control buoyancy, compressed gas source 27 contains gas. This gas will flow into and fill forward and aft ballast tanks 15, 16, purging any water therein out of orifice 32 and causing the AUV to become positively buoyant when blow valves 26 and 33 are opened. When blow valves 26 are closed and blow valves 32 are opened, no gas can flow into ballast tanks 15, 16, but water can flood the ballast tanks 15, 16 through orifices 32, causing the AUV to become negatively buoyant. Processor 21 controls whether blow valves 26 and 33 are open or closed. Optionally, compressed gas source 27 can be a mechanical pump or a chemical gas generator. Energy to operate this system can be provided from any source, such as a battery, fuel cell, or any known power source for conventional AUV's.

While the invention has been described and one example has been illustrated, various modifications, alternatives, and improvements should become apparent to those skilled in this art without departing from the spirit and scope of the invention.

What is claimed is:

1. A method of deploying cable in a body of water comprising:

providing an autonomous underwater vehicle (AUV) capable of converting vertical motion into horizontal travel, wherein the vertical motion is provided by changing buoyancy of the AUV; and placing cable on a bottom of a body of water with the AUV during the conversion of the vertical motion into the horizontal travel;

wherein substantially all the horizontal travel is achieved by converting the vertical motion.

2. Method of claim 1 wherein after placing the cable on the bottom of the body of water, the AUV retains one end of the cable and is sunk to form an anchor for the cable.

3. Method of claim 1 wherein the vertical motion is provided by sinking the AUV from a surface of the body of water, and the conversion of the vertical motion into the horizontal travel is provided by wings on the AUV.

4. Method of claim 3 wherein the AUV becomes buoyant after sinking and then rises, and the conversion of the vertical motion into the horizontal travel is provided by the wings during both the sinking and rising.

5. Method of claim 3 wherein the AUV is placed on the surface of the body of water by dropping the AUV from an airborne vehicle or a vessel on the surface of the body of water.

6. Method of claim 1 wherein the cable is housed at or near a stem of the AUV, wherein a first end of the cable is anchored at a first location on the bottom of the body of water, and cable is released from the AUV as the AUV glides.

7. Method of claim 1 wherein the AUV is dropped to the bottom of the body of water in a weighted bunker and released from the weighted bunker.

8. Method of claim 7 wherein at least two AUV's are released from the weighted bunker and cable is released from each AUV.

9. Method of claim 1 wherein the cable is a sensor array comprising fiber optic cable having a plurality of sensors arrayed on the cable.

10. Method of claim 1 wherein the buoyancy is changed by use of compressed gas to produce flood and blow cycles.

11. Method of claim 1 wherein the buoyancy is changed by use of mechanical pump.

12. Method of claim 1 wherein the buoyancy is changed by means of a chemical gas generator.

13. Method of claim 1 wherein the buoyancy is changed using an essentially noiseless orifice and valve system.

14. Method of claim 1 wherein release of cable from the AUV changes the center of buoyancy of the AUV.

15. Method of claim 1 wherein one end of the cable is connected to the AUV and is released from a housing on a deployment platform by the horizontal travel of the AUV.

16. Method of claim 1 wherein AUV position is determined by using a global positioning system (GPS) and the direction of glide is corrected using the GPS.

17. Method of claim 1 wherein the AUV is positioned in the body of water by a submarine.

18. Method of claim 1 wherein the body of water is an ocean.

19. Method of claim 1 wherein the body of water is a harbor.

20. Method of claim 1 wherein the AUV is adapted to be expendable and is used as an anchor for the deployed cable.

* * * * *